US008047107B2

(12) United States Patent
DeFigueiredo et al.

(10) Patent No.: US 8,047,107 B2
(45) Date of Patent: Nov. 1, 2011

(54) AIR TEMPERATURE NORMALIZATION IN PAPER CUTTING SYSTEM

(75) Inventors: Carlos L. DeFigueiredo, Sandy Hook, CT (US); Boris Rozenfeld, New Milford, CT (US); John W. Sussmeier, Cold Spring, NY (US); Daniel J. Williams, Woodbury, CT (US); Anthony E. Yap, Southington, CT (US)

(73) Assignee: Pitney Bowes Inc., Stamford, CT (US)

( * ) Notice: Subject to any disclaimer, the term of this patent is extended or adjusted under 35 U.S.C. 154(b) by 358 days.

(21) Appl. No.: 11/967,526

(22) Filed: Dec. 31, 2007

(65) Prior Publication Data

US 2009/0165612 A1 Jul. 2, 2009

(51) Int. Cl.
*B26D 7/10* (2006.01)
*B26D 7/08* (2006.01)

(52) U.S. Cl. ..... 83/15; 83/169; 83/170; 83/171

(58) Field of Classification Search ..... 83/169–171, 83/100, 695, 699.41, 699.61, 15; 62/320
See application file for complete search history.

(56) References Cited

U.S. PATENT DOCUMENTS 3,379,352 A * 4/1968 Hass et al. ..... 226/11
4,148,236 A * 4/1979 Holoyen et al. ..... 83/74
4,164,111 A * 8/1979 Di Bernardo ..... 53/434
4,836,072 A * 6/1989 Gerber ..... 83/152
5,072,638 A * 12/1991 Huser ..... 83/24
5,419,224 A * 5/1995 Gamperling et al. ..... 83/100
5,429,022 A * 7/1995 Nakayama ..... 83/152
5,588,345 A * 12/1996 Franks et al. ..... 83/95
5,678,466 A * 10/1997 Wahl ..... 83/168
5,699,707 A * 12/1997 Campbell, Jr. ..... 83/100
5,787,777 A * 8/1998 Ballestrazzi et al. ..... 83/100
5,819,620 A * 10/1998 Bouvarel et al. ..... 83/100
5,906,702 A * 5/1999 Crawford et al. ..... 156/251
6,202,525 B1 * 3/2001 Hendrickson et al. ..... 83/16
RE38,033 E * 3/2003 Okonski et al. ..... 83/24
6,539,829 B1 * 4/2003 Kauppila et al. ..... 83/13
7,011,004 B2 * 3/2006 Ishii et al. ..... 83/24
7,802,507 B2 * 9/2010 Ito et al. ..... 83/170

* cited by examiner

*Primary Examiner* — Boyer D Ashley
*Assistant Examiner* — Omar Flores Sanchez
(74) *Attorney, Agent, or Firm* — Brian A. Collins; Charles R. Malandra, Jr.; Steven J. Shapiro

(57) ABSTRACT

A paper cutting system includes a cutting assembly, a transport moving a web through the cutting assembly, a vacuum plenum utilizing a vacuum source to control the web moving through the cutting assembly, an air source providing purge air to the cutting assembly for removal of debris, and a heat exchanger normalizing a temperature of the purge air with respect to a temperature of ambient air prior to the purge air reaching the cutting assembly. The heat exchanger may be operated using the vacuum source.

20 Claims, 5 Drawing Sheets

AIR TEMPERATURE NORMALIZATION IN PAPER CUTTING SYSTEM

FIELD OF THE INVENTION

The present invention relates generally to a paper cutting system and, more particularly, to normalization of the purge air temperature in a paper cutting system.

BACKGROUND OF THE INVENTION

In some applications, web cutters are used to cut continuous paper webs into sheets. Web cutters may be used to provide sheets for use in various paper handling machines, such as mail processing machines, for example.

Mail processing machines are typically used by organizations such as banks, insurance companies, and utility companies for producing a large volume of specific mailings where the contents of each mail item are directed to a particular addressee. A typical mail processing machine has a number of interconnected subsystems. As shown in FIG. 1, an example of a mail processing machine 1 has a paper supply module 10 for supplying a continuous web 5 of printed material, a paper cutter 20 to cut the web into sheets 8, a sheet accumulator 30 to stack the sheets into separate stacks or collations 12, and an inserter 50 for inserting each collation into an envelope 15 supplied by an envelope supply module 40. After the inserting stage, the stuffed envelopes 18 are moved to the next stage 60 where addresses and postage indicia are provided on the envelopes.

Continuous web cutters are known in the art. In some web cutters, the web is provided as a fanfold stack. In a fanfold stack, the web is perforated and folded at the crosswise perforations. The web may have sprocket holes on both sides of the web, so that a tractor with pins can be used to engage the sprocket holes for moving the web toward the cutter. The sprocket holes are typically provided on perforations on each side of the web, and the side perforations are removed from the linked sheets before the linked sheets are moved into a cutter module, where the linked sheets are cut into separate sheets.

In some high speed web handling systems, a vacuum plenum is used to feed the web to the cutter or to hold down the web for cutting. Typically, the cutter uses a guillotine cutting module to cut the web crosswise into separate sheets at the crosswise perforations. In some devices, the guillotine cutting module has two cutting blades that are positioned on opposite sides of a perforation during a cutting cycle. The two cutting blades are simultaneously lowered to shear off the portion of the web immediately adjacent to the perforation. The removed portion is sometimes referred to as a "chip." The blades are simultaneously withdrawn from the paper path to allow the web to advance.

In other devices, the guillotine cutting module has only one cutting blade to remove the chip by shearing the web twice in each cutting cycle, one in front of the perforation and one behind the perforation.

The chips, along with any other cutting debris, are normally removed from the cutter so that they do not interfere with the cutting operation. Typically, forced air is used to blow the chips away from the cutting area into a vacuum waste system. If the forced air temperature is significantly different from the ambient air temperature around the cutting area, the cutting blades may warp. Warpage in the blade assembly may accelerate blade failure or render the blades inoperable.

SUMMARY OF THE INVENTION

In the following description, certain aspects and embodiments of the present invention will become evident. It should be understood that the invention, in its broadest sense, could be practiced without having one or more features of these aspects and embodiments. It should also be understood that these aspects and embodiments are merely exemplary.

In one aspect, the invention relates to a paper cutting system comprising a cutting assembly, a transport moving a web through the cutting assembly, a vacuum plenum utilizing a vacuum source to control the web moving through the cutting assembly, an air source providing purge air to the cutting assembly for removal of debris, and a heat exchanger normalizing a temperature of the purge air with respect to a temperature of ambient air prior to the purge air reaching the cutting assembly. The heat exchanger may be operated using the vacuum source.

As used herein, "debris" includes one or more chips (e.g., web portions adjacent to a perforation) removed from the web, as well as other pieces of paper or other material removed or produced during a web cutting operation.

Further, as used herein, "normalizing" means reducing a temperature differential between two samples of air, such as purge air and ambient air, for example. Normalizing includes cooling the air in the case where the purge air is warmer than the ambient air, and heating the air in the case where the purge air is cooler than the ambient air. "Ambient air" means the unconditioned air present in the environment in which the cutting operation is taking place, such as on a manufacturing floor, for example.

In some embodiments, the heat exchanger normalizes the temperature of the purge air by moving the purge air through a first passage and moving the ambient air through a second passage in convective communication with the first passage. As used herein, "convective communication" means the passages are in proximity so that convective heat transfer may occur between them and between the fluids they carry. In one example, the first passage may be a closed tube carrying the purge air through a second passage in which the ambient air is blown over the closed tube, thereby allowing heat transfer to occur. In other examples, the first passage and the second passage may comprise other types of conduits arranged in other ways to allow convective heat transfer.

In other embodiments, the heat exchanger normalizes the temperature of the purge air by moving the purge air through a first passage and moving one of a cooling fluid and a heating element through a second passage in convective communication with the first passage. In those embodiments, the system may further comprise at least one temperature sensor and a control system to monitor the at least one temperature sensor and control the heat exchanger.

According to another aspect, the invention provides a paper cutting system comprising a cutting assembly, a transport moving a web through the cutting assembly, a vacuum plenum utilizing a vacuum source comprising at least one fan to control the web moving through the cutting assembly, an air source providing purge air to the blade assembly for removal of debris, and a heat exchanger disposed within the vacuum plenum normalizing a temperature of the purge air with respect to a temperature of ambient air prior to the purge air reaching the cutting assembly. The heat exchanger may be operated using the at least one fan. In one embodiment, the cutting assembly comprises at least one blade disposed on a blade assembly.

In yet another aspect, the invention relates to a method of operating a paper cutting system, comprising transporting a web through a cutting assembly, controlling the web using a vacuum plenum having a vacuum source, providing purge air to the cutting assembly for removal of debris, and normalizing a temperature of the purge air with respect to a temperature of ambient air prior to the purge air reaching the cutting assembly using a heat exchanger, wherein the heat exchanger is operated using the vacuum source.

Aside from the structural and procedural arrangements set forth above, the invention could include a number of other arrangements, such as those explained hereinafter. It is to be understood that both the foregoing description and the following description are exemplary only.

BRIEF DESCRIPTION OF THE DRAWINGS

The accompanying drawings, which are incorporated in and constitute a part of this specification, illustrate exemplary embodiments of the invention and, together with the description, serve to explain the principles of the invention. In the drawings.

DETAILED DESCRIPTION OF EXEMPLARY EMBODIMENTS

Reference will now be made in detail to exemplary embodiments of the invention, examples of which are illustrated in the accompanying drawings. Wherever possible, the same reference numbers will be used throughout the drawings to refer to the same or like parts.

Figure 2:
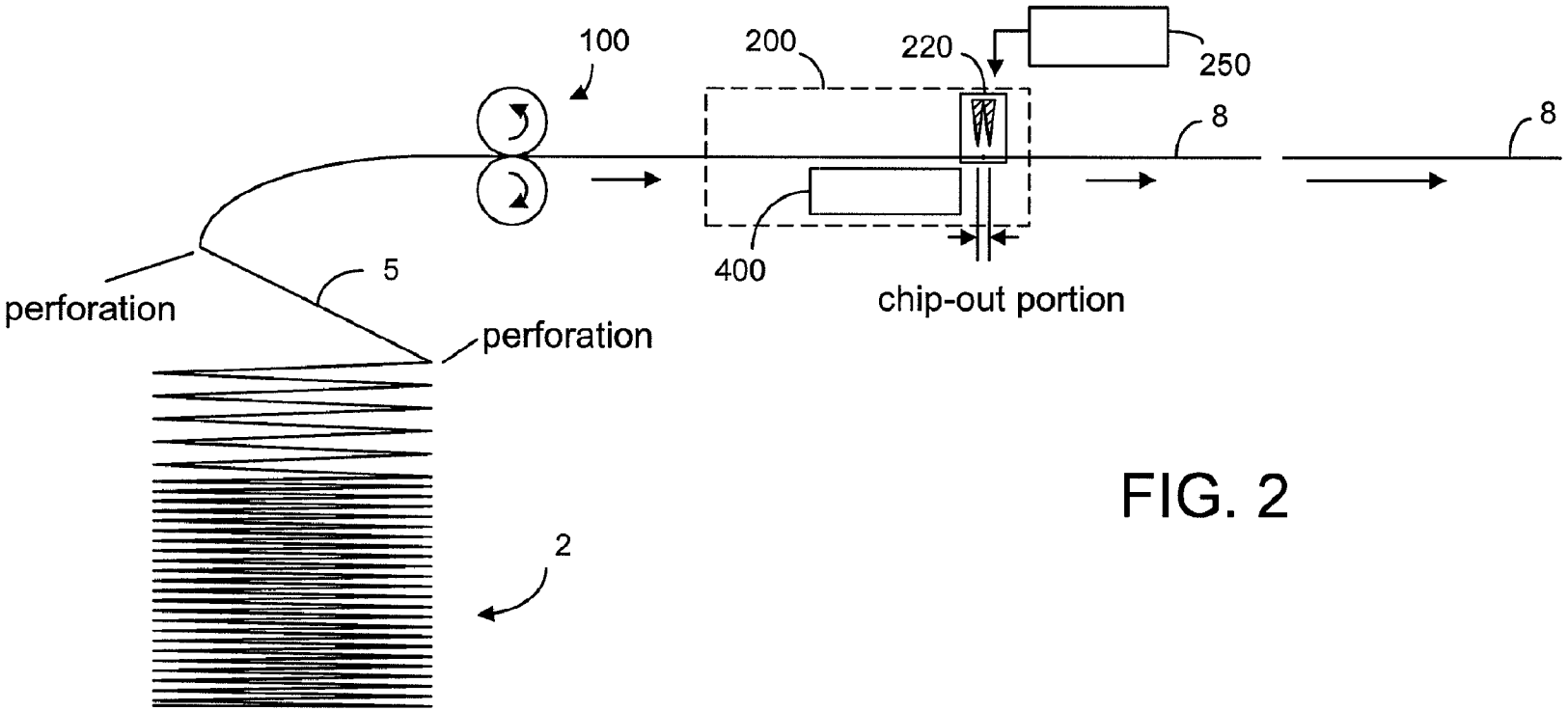
FIG. 2 is a schematic view of an embodiment of a web cutting system according to the invention.

FIG. 2 is a schematic representation of a web cutting system, according to one embodiment of the invention. As shown in FIG. 2, a fanfold stack 2 of web material 5 is fed into a web cutter 200 through a web driver 100. The web 5 is cut by a cutting assembly 220, such as a guillotine cutter, for example, into separate sheets 8. A forced air module 250 is used to provide a forced air flow to remove debris from the web cutter.

Figure 1:
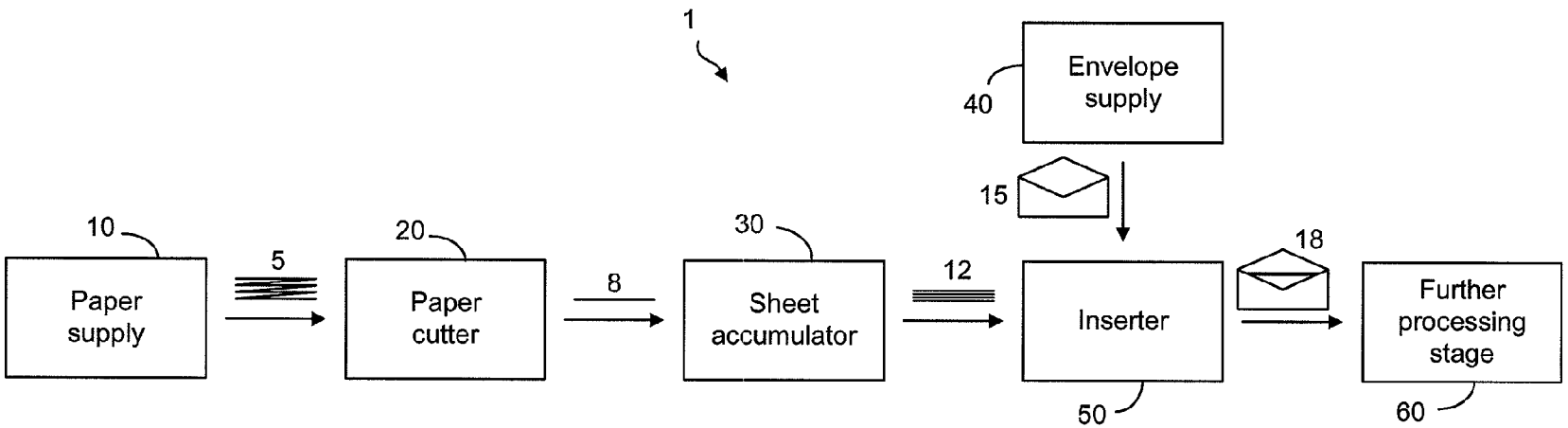
FIG. 1 is a block diagram of a conventional mail processing machine for mass mailing.

In a mail processing machine such as one depicted in FIG. 1, the sheets 8 will be moved to a sheet accumulator where the sheets are stacked into collations. The present invention is mainly concerned with the web cutter and, more particularly, to the cutting assembly 220. It should be noted that the web cutter 200 may have a vacuum plenum 400 (see FIG. 5) for holding down the web.

Many high speed guillotine cutters require compressed air for reliable removal of debris. Compressed air may come from an on-board compressor provided with the cutter or, alternatively, from a separate compressor. Standard compressors tend to increase the temperature of the output air relative to the input air temperature. Embodiments of the invention may reduce the temperature of the compressed air so that when the compressed air reaches the blade assembly, its temperature is substantially the same as the ambient air temperature.

Figure 3:
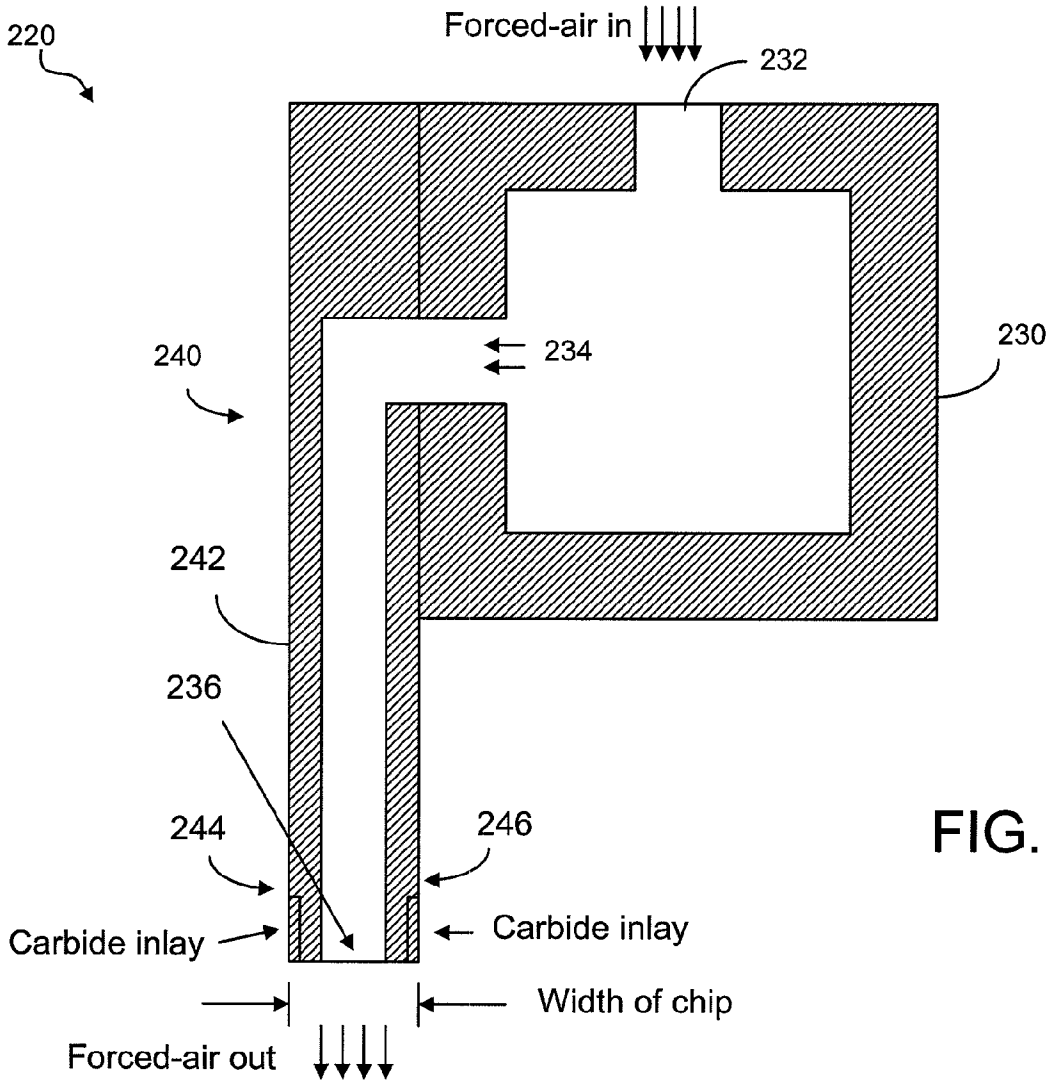
FIG. 3 is a cross-sectional view of a cutting assembly according to an embodiment of the invention.

According to one embodiment of the invention, compressed or forced air can be provided through the cutting assembly of a web cutter. As shown in FIG. 3, the cutting assembly 220 has a blade assembly 240 attached to a blade assembly holder 230 (e.g., upper blade holder). Forced air from a compressor or a forced air module enters into the upper blade holder through the inlet 232, passes through one or more holes 234 in the blade assembly 240, and then through the outlet 236. In a cutting cycle, the forced air exiting the forced air outlet provides a positive air pressure to blow the chip away from the blades. The chips are typically removed from the cutting area into a vacuum waste system (not shown). The blade assembly 240 comprises a blade holder 242 to hold two guillotine blades 244 and 246.

In some embodiments, the blade holder 242 and the blades 244, 246 are constructed from different materials with different coefficients of thermal expansion. Once the blades are assembled together with the blade holder at some ambient temperature, the blade assembly may take on the properties of a bimetallic strip and warp when heated or cooled from the assembling temperature. Even in cases where the blade holder and blades comprise the same material, minute differences in thermal expansion rates and temperature differentials throughout the assembly may cause warpage. In order to minimize or avoid warpages, it may be desirable that the forced air coming through the blade assembly 240 has a temperature closely matching the ambient temperature in the cutting area.

Warpages for various blade and blade holder materials as a function of induced temperature have been measured. The test data demonstrates a noticeable difference in the amount of warpages for blade assemblies using dissimilar materials. In some embodiments, blades have carbide inlays attached to them by brazing, gluing, or other means. Carbide may be advantageous for blade longevity, but it has a much higher coefficient of thermal expansion than steel or aluminum blade substrates. Elevating the temperature of a blade assembly containing carbide inlays may not only contribute to warping the assembly, but may impose stress on the carbide/substrate joint. A high stress may cause the detachment of the carbide from the substrate.

Figure 4:
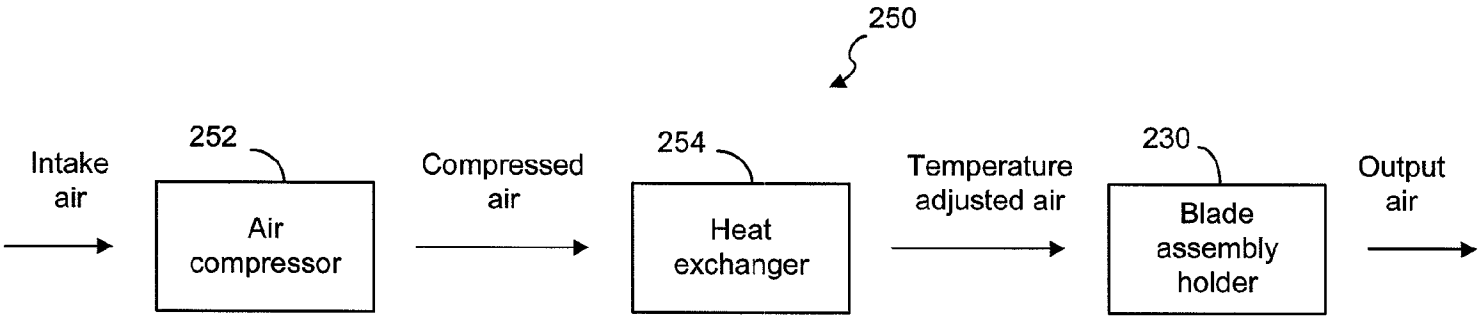
FIG. 4 is a block diagram showing an embodiment of a temperature normalization system according to the invention.

When the compressed air from the forced air module 250 has a temperature higher than the ambient temperature, the air can be cooled before it moves into the blade assembly holder 230. The cooling can be carried out by a heat exchanger system as shown in FIG. 4, for example. As shown in FIG. 4, the forced air module 250 has a compressor 252 for compressing room air into compressed air. The compressed air is cooled by a heat exchanger 254. The cooled air or temperature-adjusted air is then channeled to the blade assembly holder 230.

Figure 5:
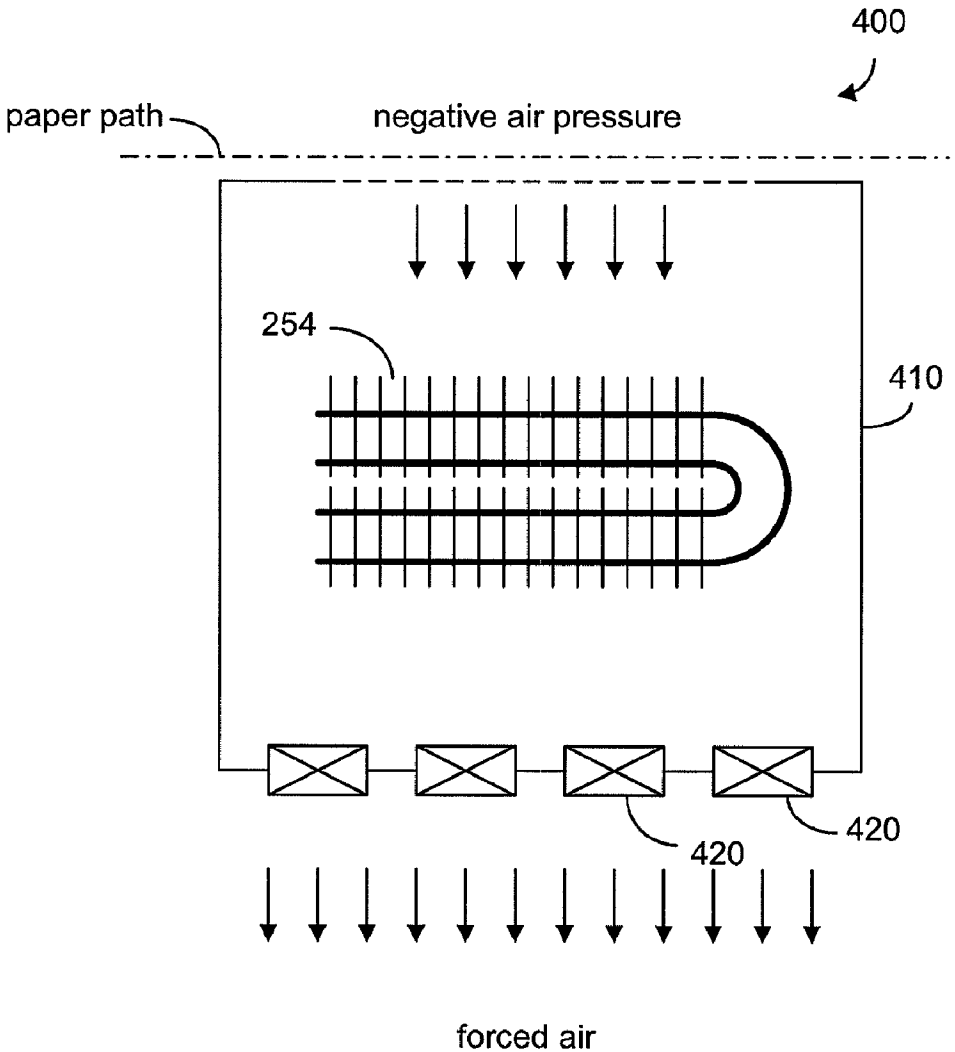
FIG. 5 is a schematic view of a portion of the device shown in FIG. 2.

As shown in FIG. 5, the vacuum plenum or vacuum suction module 400 has one or more fans 420 to draw air out of a vacuum box or housing 410. The forced air convection from the fans creates a negative air pressure at one end of the vacuum box and provides forced air at another end of the vacuum box. In one embodiment of the present invention, a heat exchanger 254 is placed inside the vacuum box to adjust the forced air temperature from the compressor, for example, as the forced air stream passes by the heat exchanger.

A typical heat exchanger has fin-like heat conducting surfaces for normalizing the forced air temperature. It has been found that such a heat exchanger is effective in reducing the forced air temperature, depending on the size and capacity of the heat exchanger, and on the temperature difference between the forced air and the fins. It should be noted that the heat absorbed by the heat exchanger from the input air can also be removed by a cooling liquid, for example. By controlling the circulation of the cooling liquid, it is possible to regulate the temperature of the forced air in the blade assembly as compared to the ambient temperature.

Figure 6:
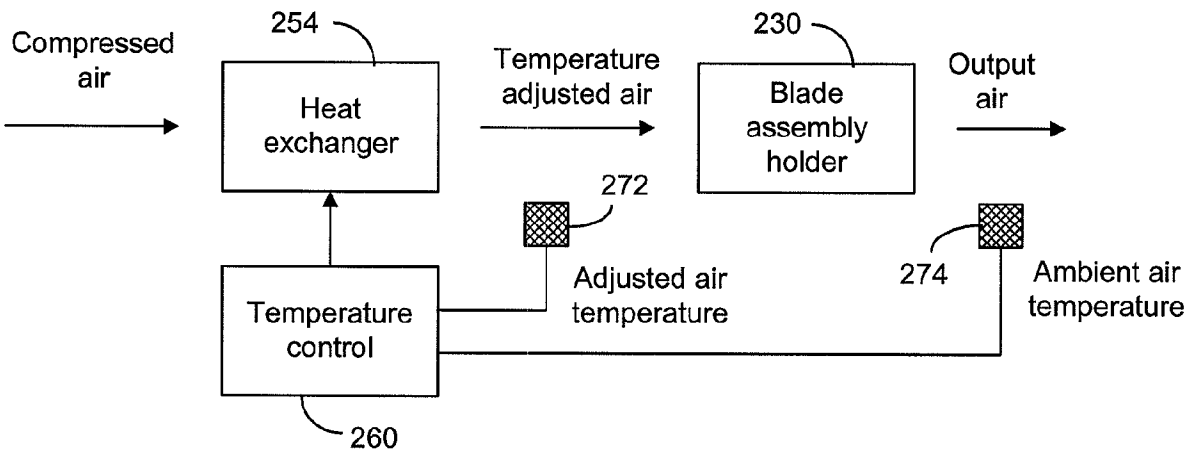
FIG. 6 is a block diagram showing an embodiment of a temperature normalization system according to the invention.

FIG. 6 shows an exemplary system for controlling the temperature of the forced air. For example, it is possible to have one temperature gauge 274 to monitor the ambient air temperature near the blade assembly holder and another temperature gauge 272 to monitor the forced air from the heat exchanger 254. Based on the difference between the temperature readings, a temperature control module 260 can be used to control the amount of cooling liquid for removing the absorbed heat in the heat exchanger, for example.

If the temperature of the compressed air is lower than the ambient air temperature, it is also possible to use a heat exchanger to increase the temperature of the compressed air. The temperature of the heat exchanger itself can be controlled by an electric heater, for example. It is possible to regulate the air temperature by controlling the electric current in the electric heater, for example.

In sum, the present invention provides a method and device for normalizing the temperature of the forced air in a blade assembly in a web cutter, so that the forced air temperature more closely matches the ambient air temperature. The adjustment of the forced air temperature can be carried out using a heat exchanger, for example. The heat exchanger can be used to reduce the forced air temperature when the compressed air has a higher temperature than the ambient temperature. The same heat exchanger can also be used to increase the forced air temperature when the compressed air has a lower temperature than the ambient temperature.

While a mail processing machine has been used to demonstrate how the temperature of the forced air in a web cutter is adjusted, the present invention is not limited to the illustrated mail processing machine. The temperature normalization of the forced air, according to various embodiments of the present invention, can be used in any web feeding device or web cutter.

It will be apparent to those skilled in the art that various modifications and variations can be made to the structure and methodology described herein. Thus, it should be understood that the invention is not limited to the examples discussed in the specification. Rather, the present invention is intended to cover modifications and variations.

What is claimed is:

1. A method of operating a paper cutting system, comprising:

transporting a web through a cutting assembly;

controlling the web using a vacuum plenum having a vacuum source;

providing purge air to the cutting assembly for removal of debris; and normalizing a temperature of the purge air with respect to a temperature of ambient air prior to the purge air reaching the cutting assembly using a heat exchanger, wherein the heat exchanger is operated using the vacuum source.

2. The method of claim 1, wherein the cutting assembly comprises:

a blade assembly holder;

a blade assembly disposed on the blade assembly holder;

at least one blade disposed on the blade assembly; and an air passage through the blade assembly holder and the blade assembly.

3. The method of claim 2, wherein the cutting assembly comprises a plurality of blades.

4. The method of claim 1, wherein the vacuum source comprises at least one fan.

5. The method of claim 1, wherein the purge air is provided from a compressed air source.

6. The method of claim 1, wherein normalizing the temperature of the purge air comprises moving the purge air through a first passage and moving the ambient air through a second passage in convective communication with the first passage.

7. The method of claim 1, wherein normalizing the temperature of the purge air comprises moving the purge air through a first passage and moving one of a cooling fluid and a heating element through a second passage in convective communication with the first passage.

8. The method of claim 7, further comprising:

measuring an air temperature at one or more locations; and controlling the heat exchanger based on the measured air temperature.

9. A paper cutting system, comprising:

a cutting assembly;

a transport moving a web through the cutting assembly;

a vacuum plenum utilizing a vacuum source to control the web moving through the cutting assembly;

an air source providing purge air to the cutting assembly for removal of debris; and a heat exchanger normalizing a temperature of the purge air with respect to a temperature of ambient air prior to the purge air reaching the cutting assembly, wherein the heat exchanger is operated using the vacuum source.

10. The paper cutting system of claim 9, wherein the cutting assembly comprises:

a blade assembly holder;

a blade assembly disposed on the blade assembly holder; and at least one blade disposed on the blade assembly.

11. The paper cutting system of claim 10, wherein the cutting assembly comprises an air passage through the blade assembly holder and the blade assembly.

12. The paper cutting assembly of claim 10, wherein the cutting assembly comprises a plurality of blades.

13. The paper cutting system of claim 9, wherein the vacuum source comprises at least one fan.

14. The paper cutting system of claim 9, wherein the air source comprises a compressed air source.

15. The paper cutting system of claim 9, wherein the heat exchanger normalizes the temperature of the purge air by moving the purge air through a first passage and moving the ambient air through a second passage in convective communication with the first passage.

16. The paper cutting system of claim 9, wherein the heat exchanger normalizes the temperature of the purge air by moving the purge air through a first passage and moving one of a cooling fluid and a heating element through a second passage in convective communication with the first passage.

17. The paper cutting system of claim 16, further comprising:

at least one temperature sensor; and a control system to monitor the at least one temperature sensor and control the heat exchanger.

18. A paper cutting system, comprising:

a cutting assembly comprising at least one blade disposed on a blade assembly;

a transport moving a web through the cutting assembly;

a vacuum plenum utilizing a vacuum source comprising at least one fan to control the web moving through the cutting assembly;

an air source providing purge air to the blade assembly for removal of debris; and a heat exchanger disposed within the vacuum plenum normalizing a temperature of the purge air with respect to a temperature of ambient air prior to the purge air reaching the cutting assembly, wherein the heat exchanger is operated using the at least one fan.

19. The paper cutting system of claim 18, wherein the heat exchanger normalizes the temperature of the purge air by moving the purge air through a first passage and moving the ambient air through a second passage in convective communication with the first passage.

20. The paper cutting system of claim 18, wherein the heat exchanger normalizes the temperature of the purge air by moving the purge air through a first passage and moving one of a cooling fluid and a heating element through a second passage in convective communication with the first passage.

* * * * *